United States Patent [19]

Urban

[11] 4,081,183

[45] Mar. 28, 1978

[54] BOARD GAME APPARATUS

[76] Inventor: Joseph A. Urban, P.O. Box 2562, Livonia, Mich. 48151

[21] Appl. No.: 768,639

[22] Filed: Feb. 14, 1977

[51] Int. Cl.[2] ..... A63F 3/00

[52] U.S. Cl. ..... 273/249; 273/263

[58] Field of Search ..... 273/134 D, 134 C, 134 E, 273/134 AD, 134 AT, 134 AC, 134 BD, 134 GP, 131 R, 131 BB, 134 B, 131 AB

[56] References Cited

U.S. PATENT DOCUMENTS

| | | | |
|---|---|---|---|
| D. 113,535 | 2/1939 | Bradley et al. | 273/134 BD |
| 1,030,970 | 7/1912 | Brunello | 273/131 R |
| 1,439,616 | 12/1922 | Diehl | 273/134 D |
| 1,694,068 | 12/1928 | Liebermann | 273/134 BD |
| 3,870,311 | 3/1975 | Klupp | 273/131 AB |

FOREIGN PATENT DOCUMENTS

| | | | |
|---|---|---|---|
| 270,152 | 5/1927 | United Kingdom | 273/134 D |
| 646,860 | 11/1950 | United Kingdom | 273/134 AD |
| 1,266,949 | 3/1972 | United Kingdom | 273/134 B |

*Primary Examiner*—Richard C. Pinkham

*Assistant Examiner*—Harry G. Strappello

[57] ABSTRACT

A game that creates a novel pursuit situation in which one or more simulated Cavemen are pursued by a simulated Dinosaur along a path that contains specific hazards and shortcuts. The game apparatus comprises: a playing board having printed thereon, a path divided into a plurality of spaces, the starting space for the simulated Dinosaur being arranged a small plurality of spaces away from the starting space of the simulated Cavemen, specific hazards and shortcuts in picture and legend along the path, pictorial representations of various dinosaurs along with their respective names and approximate dates of their existence, and the Caveman's cave of safety at the end of the path; one three dimensional simulated Dinosaur playing piece; a plurality of three dimensional simulated Cavemen playing pieces, each being differentiated from the others by its own color or configuration; one conventional cubical die to be used by the players to determine by chance the extent of movement and thereby the fate of their playing pieces.

10 Claims, 5 Drawing Figures

BOARD GAME APPARATUS

SUMMARY OF THE INVENTION

A primary object of the present invention is to provide a game to be enjoyed by children and adults which combines the excitement and suspense of a novel pursuit situation. The game board has printed thereon a circuitous path consisting of a plurality of spaces that leads from the starting space for the simulated Cavemen at the beginning of the path to a cave of safety for said Cavemen at the end.

A further object is to place the simulated Dinosaur in pursuit of the simulated Cavemen. Therefore, the Dinosaur's starting space is arranged to be a small plurality of spaced away from that of the Cavemen.

The movement of the playing pieces along the path is determined by chance by the number appearing on a conventional cubical die which is rolled, in turn, by each player.

A further object is to provide a suitable and compatible pictorial environment for the playing of the game as well as to create an interest in and a familiarity with the ancient creatures known as dinosaurs. Therefore, the gameboard has printed thereon pictorial representations of various dinosaurs along with their respective names and approximate dates of their existence.

A further object is to impede or expedite the movement of the playing pieces by means of specific hazards and shortcuts in picture and legend along the path traversed.

The simulated Cavemen have the chance probability of reaching the safety of the cave at the end of the path but the simulated Dinosaur, although at an initial spatial disadvantage at the start of the game, also has the chance probability of overtaking and capturing any or all of the said Cavemen.

The game ends when the last Cavemen has either reached the safety of the cave at the end of the path or has been captured by the Dinosaur.

These and further objects and advantages of the present invention will be readily appreciated in light of the following detailed description when considered in connection with the accompanying drawings.

DETAILED DESCRIPTION OF THE PREFERRED EMBODIMENTS

Figure 1:
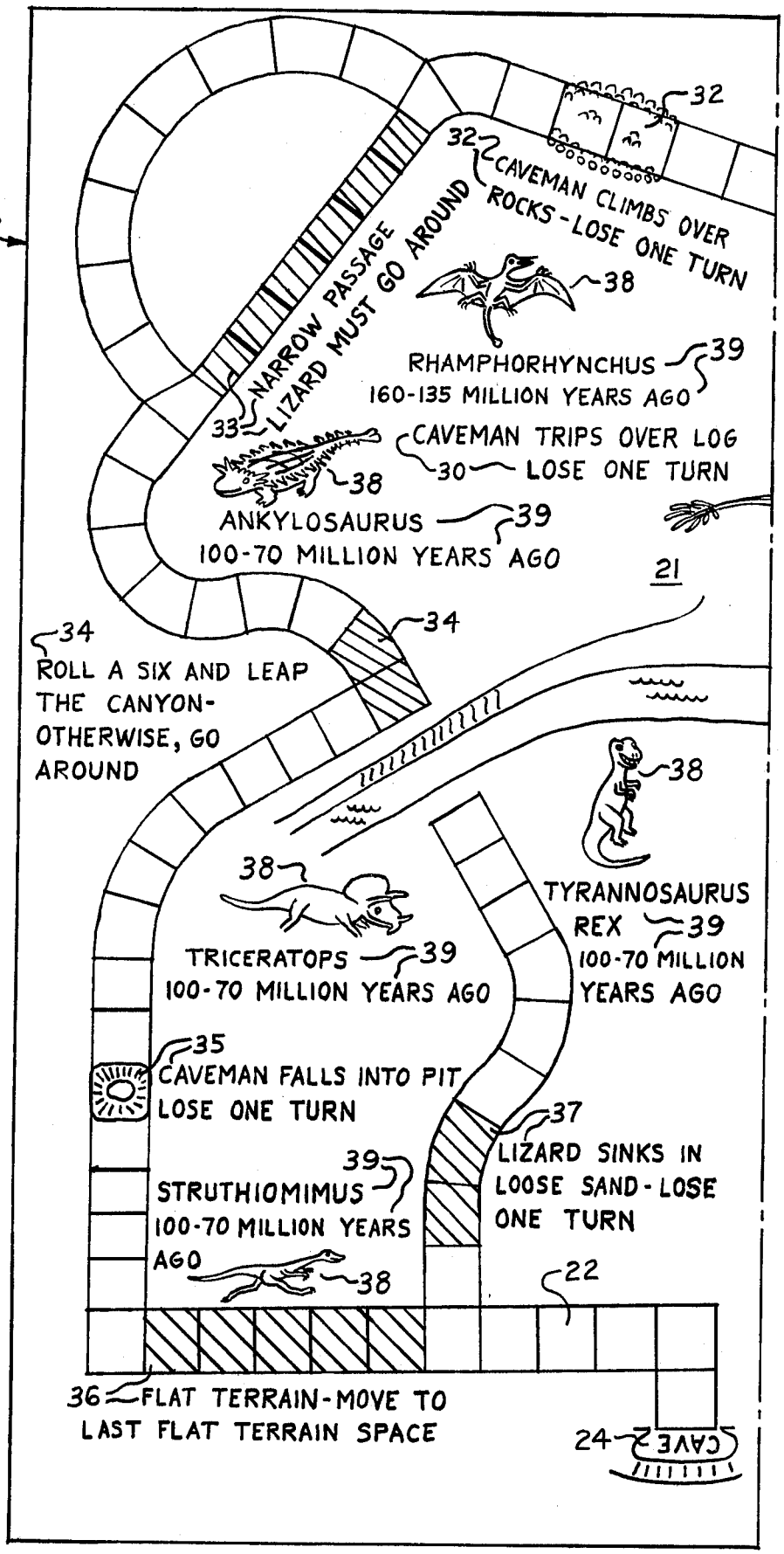
FIGS. 1 and 1A are complimentary plan views which when juxtaposed show a game board made in accordance with this invention.
Figure 1A:
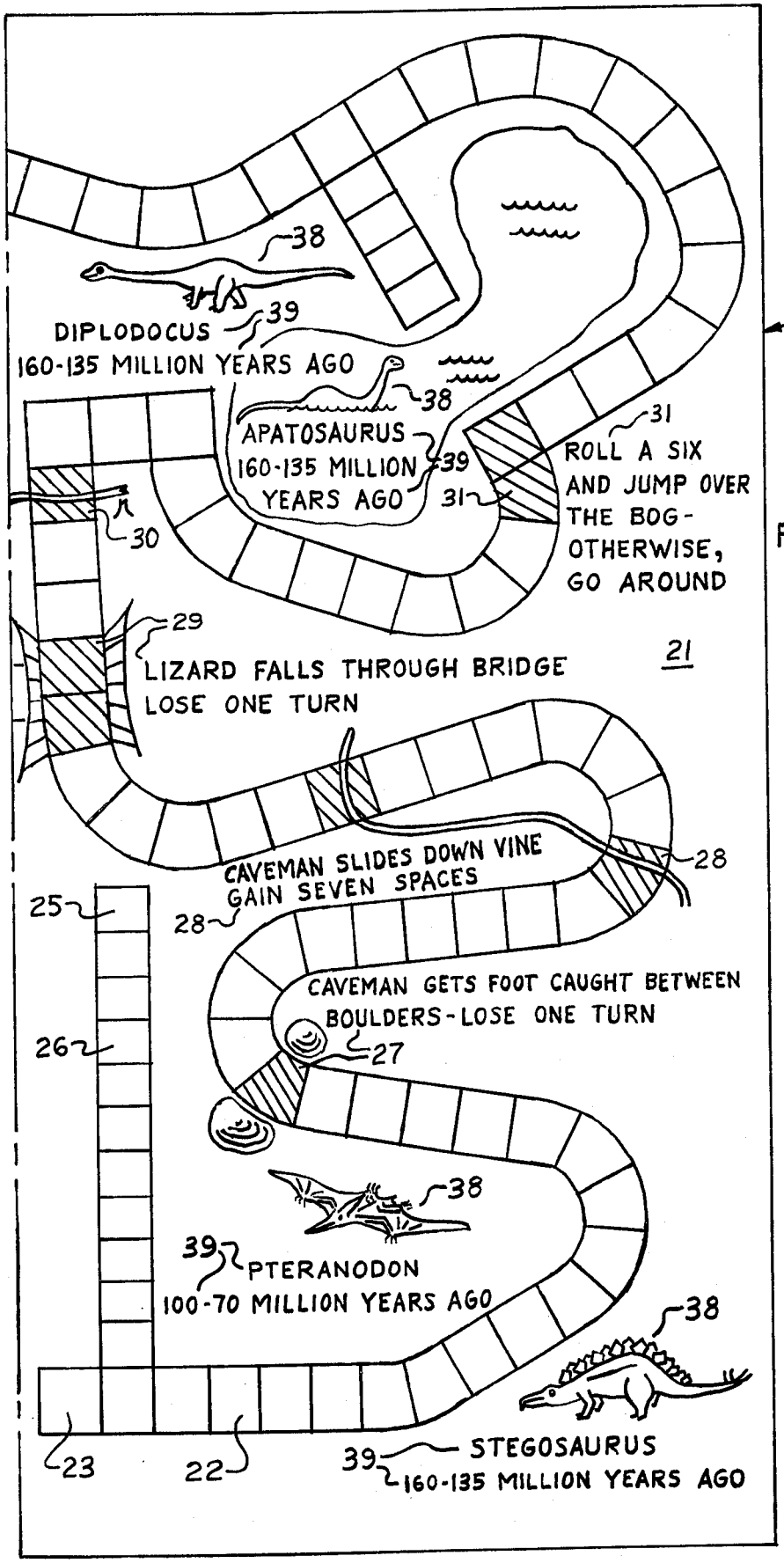

With reference being made to the drawings, FIG. 1 and FIG. 1A when juxtaposed show a substantially square game board generally designated 20, which includes a playing surface 21 which by means of suitable legends and indicia illustrates: a circuitous path 22 composed of a plurality of spaces, the beginning of the path 22 having a designated starting space 23 for the simulated Caveman 40 playing pieces, the end of the path 22 having a designated cave of safety 24 for the simulated Caveman 40 playing pieces; a designated starting space 25 and a starting path 26 for the simulated Dinosaur 41 playing piece; specific hazards and shortcuts 27 to 37 inclusive situated along the path 22; pictorial representations of various dinosaurs 38 along with their respective names and approximate dates of their existence 39.

A pursuit situation which places the Dinosaur 41 in pursuit of the Caveman 40 is created by arranging the starting space 25 of the Dinosaur 41 to be a small plurality of spaces 26 away from the starting space 23 for the Cavemen 40.

The specific hazards and shortcuts 27 to 37 inclusive referred to above and included in the preferred embodiments of the present invention are: Cavemen gets foot caught between boulders. Lose one turn. 27; Caveman slides down vine. Gain seven spaces. 28; Lizard falls through bridge. Lose one turn. 29; Caveman trips over log. Lose one turn. 30; Roll a six and jump over the bog. Otherwise, go around. 31; Caveman climbs over rocks. Lose one turn. 32; Narrow passage. Lizard must go around. 33; Roll a six and leap the canyon. Otherwise, go around. 34; Caveman falls into pit. Lose one turn. 35; Flat terrain. Move to last flat terrain space. 36; Lizard sinks in loose sand. Lose one turn. 37. Because the word, dinosaur, means "terrible lizard," the term lizard is used to refer to the Dinosaur 41 in the specific hazards and shortcuts designated 29, 33, and 37, described above.

The pictorial representations of various dinosaurs 38 along with their respective names and approximate dates of their existence 39 are utilized to provide a suitable and compatible pictorial environment for playing the game as well as to create an interest in and a familiarity with the ancient creatures known as dinosaurs.

Figure 2:
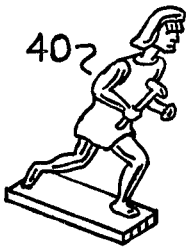
FIG. 2 is a perspective view of an embodiment of a Caveman playing piece made in accordance with this invention.

The embodiment of FIG. 2 shows the Caveman 40 playing piece. The plurality of Cavemen 40 playing pieces may be distinguished from one another by such means as individual color or configuration.

Figure 3:
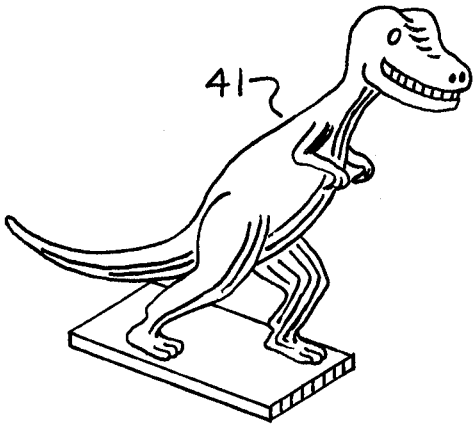
FIG. 3 is a perspective view of an embodiment of a Dinosaur playing piece made in accordance with this invention.

The embodiment of FIG. 3 shows a Dinosaur 41 playing piece.

Figure 4:
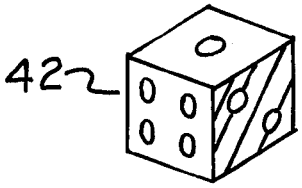
FIG. 4 is a perspective view of a conventional cubical die.

FIG. 4 shows a conventional cubical die 42.

The game may be played by two or more players, one of which would use the Dinosaur 41 playing piece.

The object of the game is for the players using the Caveman 41 playing pieces, and starting a small plurality of spaces 26 ahead of the Dinosaur 41, to traverse the path 22 from start 23 to finish 24 without being captured by the pursuing Dinosaur 41.

The players who are cavemen 40 determine whose turn is first, second, etc., by rolling the die 42 or by some other agreement. The player who is the Dinosaur 41 is always the last to roll the die 42 in each sequence of turns.

Before the start of the game, the Cavemen 40 are placed on their start space 23 and the Dinosaur 41 is placed on its start space 25. The game begins when the player who is the Caveman 40 who has the first turn in the first sequence of turns rolls the die 42 and moves his Caveman 40 playing piece the number of spaces along the path 22 that correspond to the number of dots appearing on the top side of the die 42. Each remaining player does likewise, in turn, with the player who is the Dinosaur 41 being the last to roll the die 42. This sequence of play is repeated indefinitely until the last Caveman 40 has either reached the cave of safety 24 at the end of the path 22 or has been captured by the Dinosaur 41.

The roll of the die 42, in turn, by each player determines by chance the movement of the playing pieces 40 and 41 along the paths 22 and, 26 and 22 respectively. This chance movement further determines which playing pieces 40, 41 encounter which if any hazards and/or shortcuts 27 to 37 inclusive thereby impeding or expediting their progression along the path 22 and contributing to the Caveman 40 either reaching the cave of safety 24 or being captured by the Dinosaur 41.

When the player who is the Dinosaur 41 rolls a number that permits the Dinosaur 41 to catch up to the Caveman 40, the Dinosaur 41 must stop on that space occupied by the Caveman 40 even though the number rolled would permit it to go farther. That Caveman 40 is then captured by the Dinosaur 41 and is removed from the board 20. If more than one Caveman 40 occupy the same space when the Dinosaur 41 arrives, all are captured and removed.

The hazards and shortcuts 27 to 37 inclusive apply as indicated. If a Caveman 40 or the Dinosaur 41 lands on either of the two spaces in front of the bog 31 or canyon 34 and rolls a six on the next turn, he may jump across but must stop in the first space on the other side until his next turn. The flat terrain 36 applies to the Caveman 40 and to the Dinosaur 41. If either stops on any flat terrain space, he moves to the last flat terrain space. If a playing piece lands on the first space of the a two space hazard such as 29, 32, or 37, loses one turn and the respective player rolls a one on his next turn, the player moves his playing piece to the second space of the hazard and loses another turn.

If the Dinosaur 41 manages to get in front of any Caveman 40, thereby cutting him off from reaching the cave of safety 24, the Dinosaur 41 must stop on that space. All Cavemen 40 behind the Dinosaur 41 are considered captured and are removed from the board 20.

The game ends when only the Dinosaur 41 is left or the last Caveman 40 has safely reached the cave of safety 24. The players who are Cavemen 40 must roll a number on the die 42 large enough to get each Caveman 40 past the last space of the path 22 and into the cave of safety 24. If a Caveman 40 has stopped on the last space of the path 22, he has not yet reached the cave of safety 24 and can be captured by the Dinosaur 41.

Although the invention has been described and illustrated with respect to a preferred embodiment thereof, it is to be understood that it is not to be so limited because alternatives, modifications, and variations may be made therein by those skilled in the art in light of the foregoing description. Accordingly, it is intended to embrace all such alternatives, modifications, and variations as fall within the spirit and broad scope of the following claims:

I claim:

1. A game that creates a novel pursuit situation, said game comprising in combination:

a. a game board having marked thereon: a plurality of spaces in succession that constitute a primary path of progression about the board and includes a common starting space for the plurality of pursued playing pieces and a specific space of safety for said pursued playing pieces at the end of said path; a separate small plurality of spaces in succession that constitute a secondary path that is the initial starting path for the pursuing playing piece and has at one end of separate starting space for the pursuing playing piece, the other end of said path connecting directly with the first space of the primary path; a series of specific hazards and shortcuts in picture and legend situated along the primary path to be encountered by chance by the playing pieces and intended to impede or to expedite the movement of said playing pieces; a pictorial representation of various dinosaurs along with their respective names and approximate dates of their existence situated at various locations on the game board, b. a plurality of playing pieces adapted to indicate the pursued Cavemen, c. a singular playing piece adapted to indicate the pursuing Dinosaur, d. a conventional cubical die used to determine by chance the progress and thereby the fate of the playing pieces during the game.

2. The game apparatus of claim 1 wherein one playing piece is in pursuit of one or more other playing pieces.

3. The game apparatus of claim 1 wherein a simulated Dinosaur playing piece is in pursuit of one or more simulated Caveman playing pieces.

4. The game apparatus of claim 1 wherein a novel pursuit situation is created by use of a primary path of progression for the pursued playing pieces to which is connected a secondary path that is the initial starting path for the pursuing playing piece.

5. The game apparatus of claim 1 wherein the series of specific hazards and shortcuts in picture and legend situated along the primary path are comprised of:

a. Caveman gets foot caught between boulders. Lose one turn., b. Caveman slides down vine. Gain seven spaces., c. Lizard falls through bridge. Lose one turn., d. Caveman trips over log. Lose one turn., e. Roll a six and jump over the bog. Otherwise go around., f. Caveman climbs over rocks. Lose one turn., g. Narrow passage. Lizard must go around., h. Roll a six and leap the canyon. Otherwise go around., i. Caveman falls into pit. Lose one turn., j. Flat terrain. Move to last flat terrain space., k. Lizard sinks in loose sand. Lose one turn, the term, "lizard," as used in 5.c., 5.g., and 5.k., applies to the Dinosaur playing piece and derives from the fact that the word, dinosaur, means "terrible lizard."

6. The game apparatus of claim 5 wherein hazards or shortcuts are comprised of two or more successive spaces so that the playing piece has the chance probability of being impeded for more than one turn in a row at such hazards as exemplified by 5.c., 5.f., and 5.k., or has the chance probability of being expedited at such shortcuts as exemplified by 5.b., 5.e., 5.h., and 5.j.

7. The game apparatus of claim 1 wherein the pictorial representations of various dinosaurs along with their respective names and approximate dates of their existence are utilized to create an interest in and a familiarity with the ancient creatures known as dinosaurs.

8. The game apparatus of claim 1 wherein a plurality of playing pieces are adapted to indicate the pursued Cavemen.

9. The game apparatus of claim 1 wherein the pictorial representations of various dinosaurs along with their respective names and approximate dates of their existence are utilized to provide a suitable and compatible pictorial environment for the playing of the game.

10. The game apparatus of claim 1 wherein a singular playing piece is adapted to indicate the pursuing Dinosaur.

* * * * *